US005829353A

United States Patent [19]

Ellis

[11] Patent Number: 5,829,353

[45] Date of Patent: Nov. 3, 1998

[54] METHOD OF MODULATING LITHOGRAPHIC AFFINITY AND PRINTING MEMBERS MADE THEREBY

[75] Inventor: Ernest W. Ellis, Harvard, Mass.

[73] Assignee: Presstek, Inc., Hudson, N.H.

[21] Appl. No.: 877,942

[22] Filed: Jun. 18, 1997

[51] Int. Cl.[6] ..... B41N 1/14

[52] U.S. Cl. ..... 101/460; 101/462; 101/465; 101/466; 101/467

[58] Field of Search ..... 101/453, 454, 101/455, 457, 462, 463.1, 465, 466, 467, 460; 430/302, 303

[56] References Cited

U.S. PATENT DOCUMENTS

| | | | |
|---|---|---|---|
| 3,592,137 | 7/1971 | Newman | 101/457 |
| 4,126,530 | 11/1978 | Thornton | 204/192 |
| 4,863,756 | 9/1989 | Hartig et al. | 427/39 |
| 5,238,778 | 8/1993 | Hirai et al. | 101/467 |
| 5,364,665 | 11/1994 | Felts et al. | 427/571 |
| 5,380,612 | 1/1995 | Kojima et al. | 430/302 |
| 5,417,164 | 5/1995 | Nishida et al. | 101/462 |
| 5,695,908 | 12/1997 | Furukawa | 101/466 |

OTHER PUBLICATIONS

Bernier et al., "Polymer Surface Modification by Dual–Frequency Plasma Treatment," *Metallization of Polymers* at 147 (ACS Symp. Ser. 440, 1990).

Pinizzotto, "A review of silicon–on–insulator formation by oxygen ion implantation," *J. Vac. Sci. Technol.* A2 (2):597–98 (Apr.–Jun. 1984).

Chiu et al., "The Material Properties of Silicon Nitride Formed by Low Energy Ion Implantation," *J. Electrochem. Soc.* 131(9):2110–15 (1984).

Current, et al., "Ion Implantation Processing," *Proc. of Tutorial Symp. on Semicond. Tech.* (1982).

Wilson, *Semiconductor Silicon 1986* 86–4:621–641 (1986).

*Primary Examiner*—Stephen R. Funk

*Attorney, Agent, or Firm*—Cesari and McKenna, LLP

[57] ABSTRACT

The lithographic affinity characteristics of a material, such as a polymer, are affected—and thereby selectively modulated—through implantation of one or more metallic materials, typically in the form of ions and/or atoms (or molecules). The desired characteristics are achieved by bulk chemical modification of the material rather than by texturing or deposition of a new surface layer. In the case of a polymer system, for example, the metal impregnates the matrix, penetrating to an observable depth without substantial surface accumulation.

31 Claims, 1 Drawing Sheet

METHOD OF MODULATING LITHOGRAPHIC AFFINITY AND PRINTING MEMBERS MADE THEREBY

BACKGROUND OF THE INVENTION

1. Field of the Invention

The present invention relates to lithographic printing apparatus and methods, and more particularly to manufacture of lithographic printing members suitable for automated imaging.

2. Description of the Related Art

In offset lithography, an image to be transferred to a recording medium is represented on a plate, mat or other printing member as a pattern of ink-accepting (oleophilic) and ink-repellent (oleophobic) surface areas. In a dry printing system, the member is simply inked and the image transferred onto a recording material; the member first makes contact with a compliant intermediate surface called a blanket cylinder which, in turn, applies the image to the paper or other recording medium. In typical sheet-fed press systems, the recording medium is pinned to an impression cylinder, which brings it into contact with the blanket cylinder.

In a wet lithographic system, the non-image areas are hydrophilic in the sense of affinity for dampening (or "fountain") solution, and the necessary ink-repellency is provided by an initial application of such a solution to the plate prior to or during inking. The ink-abhesive fountain solution prevents ink from adhering to the non-image areas, but does not affect the oleophilic character of the image areas.

A lithographic image is applied to a blank plate by altering its affinity characteristics in an imagewise pattern—that is, a pattern corresponding to the material to be printed. This may be accomplished photographically, by imagewise exposure of the blank plate to appropriate radiation followed by chemical development, or physically, using (for example) digitally controlled lasers to remove or facilitate mechanical removal of one or more plate layers in the imagewise pattern.

In a laser-based direct-write process, the laser imagewise removes (or facilitates removal of) ink-rejecting, non-image portions of the printing blank to reveal an ink-accepting layer that carries the image. In an indirect-write system, the laser instead removes ink-accepting portions of the blank. The choice of imaging mode depends less on the characteristics of the imaging system (since in digitally operated systems the mode can be changed merely by inverting the output bitmap) than on the structure of the printing member employed.

Lithographic printing members are now commonly imaged by low-power ablation imaging mechanisms. U.S. Pat. No. 5,339,737 and Reissue Pat. No. 35,512 (the entire disclosures of which are hereby incorporated by reference), for example, disclose a variety of ablation-type lithographic plate configurations for use with imaging apparatus that utilize diode lasers. For example, laser-imageable lithographic printing constructions in accordance with these patents may include a first, topmost layer chosen for its affinity for (or repulsion of) ink or an ink-abhesive fluid; an ablation layer, which volatilizes into gaseous and particulate debris in response to imaging (e.g., infrared, or "IR") radiation, thereunder; and beneath the imaging layer, a strong, durable substrate characterized by an affinity for (or repulsion of) ink or an ink-abhesive fluid opposite to that of the first layer. Ablation of the imaging layer weakens the topmost layer as well. By disrupting its anchorage to an underlying layer, the topmost layer is rendered easily removable in a post-imaging cleaning step, creating an image spot having an affinity for ink or an ink-abhesive fluid differing from that of the unexposed first layer.

Alternatively, the construction may consist of two participating layers exhibiting opposite printing affinities, one of which is subject to ablative absorption of imaging radiation. For example, the ablation layer may be a metallic inorganic layer (see copending application Ser. No. 08/700,287, entitled THIN-FILM IMAGING RECORDING CONSTRUCTIONS INCORPORATING METALLIC INORGANIC LAYERS AND OPTICAL INTERFERENCE STRUCTURES, filed on Aug. 20, 1996, the entire disclosure of which is hereby incorporated by reference), which is hydrophilic in the printing sense of accepting fountain solution; and the other layer may be a hydrophobic, oleophilic material such as polyester.

Obtaining materials exhibiting an optimal combination of properties for use in printing members can prove challenging. Each layer participating in the printing process must be durable enough to withstand the high-stress environment of commercial printing over thousands or tens of thousands of impressions; strongly exhibit the proper affinity while excluding the opposite affinity; be responsive, as necessary, to the imaging mode (e.g., ablating in response to laser radiation); be amenable to convenient and economical manufacture; and facilitate convenient and economical combination with the other plate layers to produce a finished plate. These properties can conflict; for example, it may be difficult to find materials subject to low-power ablation that also exhibit commercially useful durability. The materials that have become routinely accepted in the art usually reflect compromises among desirable properties required by the limited choice of available materials.

DESCRIPTION OF THE INVENTION

Brief Summary of the Invention

It has been discovered, surprisingly, that the affinity characteristics of a material may be strongly affected—and thereby selectively modulated—through implantation of one or more inorganic materials, typically in the form of ions and/or atoms (or molecules). The desired characteristics are achieved by bulk chemical modification of the material rather than by texturing or deposition of a new surface layer, as in older approaches. In the case of a polymer system, for example, the inorganic material impregnates the matrix, penetrating to an observable depth without substantial surface accumulation.

The prior art contains numerous approaches to surface modification in order to obtain improved adhesion, wettability, printability, or dye-uptake characteristics. These include corona discharge; glow-discharge plasmas; low-pressure, low-temperature nonequilibrium plasma treatment; and dual-frequency plasma treatment. See, e.g., Bernier et al., "Polymer Surface Modification by Dual-Frequency Plasma Treatment," *Metallization of Polymers* at 147 (ACS Symp. Ser. 440, 1990). These typically incite effects through alteration of the surface structure (for example, enhancing wettability through creation of a three-dimensional topology). Other processes, such as sputtering or ion implantation, result in application of a physically distinct surface or below-surface layer.

In accordance with the present invention, an inorganic material (typically in molecular, atomic or ionic form) is driven into the volume of an acceptor material, which is usually in sheet form. In preferred approaches, metal ions and/or atoms are impregnated into a polymer matrix by sputtering or by ion implantation so as to form an in situ dispersion. Either process may, if desired, be combined with reactive etching to improve the penetration of ions. Again, while these processes are known in the prior art, they have been employed for purposes different from—and in some ways antithetical to—that of the present invention. Ion implantation, for example, has been used to form silicon-on-insulator structures by implanting large doses of atomic or molecular oxygen ions to form a buried oxide layer with sharp interfaces after annealing, or to deposit surface films such as silicon nitride or silicon oxynitride on silicon wafers. See, e.g., Pinizzotto, *J. Vac. Sci. Technol* . A2(2):597–98 (April–June 1984); Chiu et al., *J. Electrochem. Soc.* 131(9):2110–15 (1984).

It is unexpected that penetration and dispersion of an inorganic material within, rather than above, a material matrix, and without substantial surface modification, can effect the pronounced alteration of affinity properties as has been observed. Indeed, it has been found that judicious choice of the implanted phase can completely alter the native characteristics of the original material. For example, normally hydrophobic polyester can be rendered hydrophilic through implantation of aluminum (itself hydrophilic in a textured or oxidized state), while the natural oleophilicity of polyester can be enhanced through implantation of copper.

Accordingly, through application of the invention, materials heretofore considered unsuitable for lithographic printing constructions due to undesirable affinity characteristics, but nonetheless possessing useful properties (e.g., durability), can be modified to function lithographically. Furthermore, using the process of the invention, the printing performance of conventional lithographic-plate material can be improved.

BRIEF DESCRIPTION OF THE DRAWING

The foregoing discussion will be understood more readily from the following detailed description of the invention, when taken in conjunction with the single figure of the drawing, which illustrates a representative printing-plate construction attainable in accordance with the present invention.

DETAILED DESCRIPTION OF THE PREFERRED EMBODIMENTS

Figure 1:
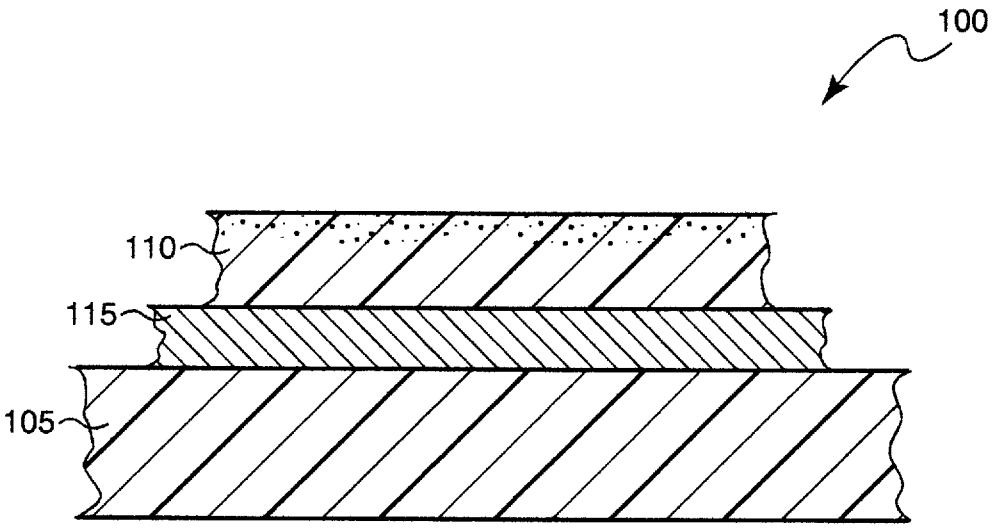

Although numerous methods can be used to introduce atomic-scale particles into a material such as a polymer, the preferred approach is to use a sputtering or ion-implantation process. In conventional cathode sputtering, an ionized gas is electrically accelerated toward a cathode surface to drive off or "sputter" atoms of the cathode material. A substrate placed in the path of the sputtered atoms is coated with the cathode material. If the electric field is strong enough, the sputtered atoms will penetrate the substrate. Alternatively, the substrate may also be electrically biased to attract ionized material and thereby disrupt and drive off substrate surface material, improving the penetration of cathode material.

In an alternative approach to the invention, inorganic atoms or molecules are introduced into a substrate material through ion implantation. In this approach, the material to be implanted is subject (typically in the vapor phase) to an electric field to form an ionic plasma, and the ionized material is focused onto the substrate as a beam. Suitable ion implantation equipment is readily available and well characterized in the art; see, e.g., *Handbook of Ion Implantation Technology*, J. F. Ziegler, ed. (1992); Current et al., "Ion Implantation Processing," *Proc. of Tutorial Symp. on Semicond. Tech.* (1982).

In a variant of ion implantation, a plasma etching is carried out using, as the powered electrode, the inorganic material (in this case, usually metallic) to be implanted. With this approach, the substrate is affixed—generally as a sheet—to a grounded metal plate of similar dimension. A powered electrode (usually also of the same dimension) is spaced from the substrate, air is evacuated, and a working gas is introduced into the space between the powered electrode and the substrate. Application of a strong electric field to the powered electrode produces a plasma of the working gas, which heats, disrupts and, in "reactive plasma etching," reacts with the surface of the substrate. Conventional plasma etching is typically used to clean a surface and create thereon a uniform, roughened topology; an AC field cyclically drives oppositely charged species against and away from the surface, thereby entraining and removing debris along with uneven surface features. Generally, the AC field is of a relatively low frequency to allow for sufficient ion movement between phase reversals. Reactive plasma etching is used to deposit a coating developed by reaction among species of the working gas, or to cause reaction between the working gas species and the surface of the substrate.

In accordance with the present invention, however, etching is used to render the surface of the substrate vulnerable to penetration by ions ejected from the powered electrode as a consequence of the alternating field. The field strength and frequency are chosen such that, with an electrode comprising one or more materials of interest, an adequate concentration of material is deposited within the substrate. These parameters are straightforwardly determined by those skilled in the art without undue experimentation.

Because no surface coating is necessary to obtain the effects of the present invention, reactive etching is unnecessary, but may be employed if, in addition to improving affinity characteristics of the substrate, it is also desired to improve adhesion capability to an overlying layer. In this case, the gas mixture comprises species that react to form a film which, when deposited onto the surface of the substrate, produces an adhesion coating. Typically, this coating is destroyed at image points when the resulting printing member is processed, but remains to anchor the reactively etched substrate in areas that have not received imaging exposure.

It should be stressed that the objective of the invention is the dispersion of controlled amounts of an inorganic material into a matrix, such as a polymer. Accordingly, other vacuum or non-vacuum techniques involving impregnation or, for example, pre-curing dispersion of fine inorganic particles into a polymer precursor, as will be appreciated by those of skill in the art, can also be used to advantage.

The present invention is suitable for modifying a wide variety of surfaces. For example, oleophilic polymers such as polyester, polycarbonates, polyolefins, etc. can be made more oleophilic (e.g., through impregnation with copper), thereby improving performance as ink receptors. Similarly, hydrophilic polymers such as polyvinyl alcohols can be impregnated with a metal such as aluminum to enhance hydrophilicity. Alternatively, otherwise desirable materials exhibiting insufficient or even improper affinity can be modified so as to render them useful in a desired application. For example, normally hydrophobic polyester can be rendered hydrophilic (i.e., capable of accepting fountain solution), so that two sheets of the same polyester material—one treated by implanting aluminum, the other untreated—can be disposed one atop the other to form a lithographic plate construction.

Refer to FIG. 1, which illustrates a representative form of printing plate obtainable in accordance herewith. The plate 100 includes first and second layers 105, 110 exhibiting a different affinity for fountain solution and/or ink. For example, layer 105 may be an ink-receptive polyester, while surface layer 110 is oleophobic or hydrophilic. As set forth above, layer 105 may be treated through impregnation of copper to increase oleophilicity, while a hydrophilic layer 110 may be treated through impregnation of aluminum to enhance hydrophilicity. The treatment of layer 110 may be accomplished before or after its application to layer 105. Depending on the manner in which plate 100 is to be imaged, it may be appropriate to add an imaging layer 115 between layers 105, 110 (e.g., to ablate in response to imaging radiation and thereby faciliate selective removal of layer 110 in imaged areas). Methods of fabricating such lithographic plate constructions are extensively disclosed in the '512 and '737 patents.

Metals such as copper, gold, silver, platinum, and palladium can all be used to enhance ink-receptivity (oleophilicity). Metals such as aluminum, magnesium, and zinc are useful in enhancing hydrophilicity. In addition to metals and metal alloys, other inorganic materials—such as intermetallics and metal-nonmetal compounds—can also be used. For example, hydrophilicity can be enhanced through impregnation with titanium nitride. Other hydrophilicity-enhancing metal-nonmetal compounds are disclosed in the '287 application mentioned above. In particular, preferred compounds include a metal component that may be a d-block (transition) metal, an f-block (lanthanide) metal, aluminum, indium or tin, or a mixture of any of the foregoing (an alloy or, in cases in which a more definite composition exists, an intermetallic). Suitable metals include titanium, zirconium, vanadium, niobium, tantalum, molybdenum, and tungsten. The nonmetal component may be one or more of the p-block elements boron, carbon, nitrogen, oxygen, and silicon. A metal-nonmetal compound in accordance herewith may or may not have a definite stoichiometry, and may in some cases (e.g., Al-Si compounds) be an alloy. Representative metal-nonmetal combinations include TiN, TiON, $TiO_x$, (where $0.9 \leqq x \leqq 2.0$), TiAlN, TiAlCN, TiC and TiCN.

EXAMPLE

A 15.75"×20.3"×0.007" test printing plate was constructed by splicing two 15.75"×10.15"×0.007" polyester substrates having different affinity characteristics. The substrates were prepared by separate RF (radio frequency) induced reactive-etching processes in a vacuum chamber using a reactive gas mixture of 50:50 argon and nitrogen. In a first procedure a copper plate was used as the powered electrode, and in a second procedure an aluminum plate was used as the powered electrode. RF power, gas pressure and time were modulated to achieve varying degrees of etch and cause amidization (i.e., surface reaction with nitrogen to form amides).

The resulting spliced printing plate was mounted on an offset lithographic printing press and used as a wet plate to print paper sheets with black ink. The copper-etched sides printed black, indicating oleophilicity, while the aluminum-etched sides remained unprinted, indicating hydrophilicity.

The copper-impregnated substrate was subsequently sputtered with 300 Å of titanium followed by 300 Å of titanium nitride, and finally overcoated with a thin layer of protective polyethylene glycol/Klucel G or 99-G "FF" grade hydroxypropyl cellulose (supplied by the Aqualon division of Hercules Inc., Wilmington, Del.) to provide a complete printing-plate structure possessing improved ink-receptivity characteristics.

In a separate experiment, a spliced single-layer printing plate as described above was imaged using an IR-imaging unit as described in the '512 and '737 patents. The same results were obtained, indicating that the action of the laser beam on the surface of the plate did not modify the above-described affinity characteristics.

Another printing-plate construction to which the invention is advantageously applied includes, as a substrate, the white, IR-reflective 329 film supplied by ICI Films, Wilmington, DE; a titanium ablation layer; and a TiN surface layer. The substrate is oleophilic and the TiN surface layer hydrophilic. By reactively etching the substrate prior to plate manufacture, using a copper electrode in an atmosphere including nitrogen or oxygen, ink receptivity is enhanced due to copper impregnation and adhesion of the substrate to the subsequently applied titanium is improved through surface reaction. (As emphasized previously, these effects are independent, and it is unnecessary to reactively modify the surface in order to obtain the benefits of affinity enhancement through impregnation.)

It will therefore be seen that the foregoing approach to modification of affinity characteristics of lithographic printing-member components affords substantial flexibility in terms of optimizing properties and expanding the range of useful materials. The terms and expressions employed herein are used as terms of description and not of limitation, and there is no intention, in the use of such terms and expressions, of excluding any equivalents of the features shown and described or portions thereof, but it is recognized that various modifications are possible within the scope of the invention claimed.

What is claimed is:

1. A method of preparing a lithographic printing plate comprising first and second layers having, respectively, first and second different affinities for at least one printing liquid selected from the group consisting of ink and an abhesive fluid for ink, the method comprising:

a. implanting, into a first layer having an initial affinity, at least one inorganic material, the inorganic material altering the initial affinity to the first affinity; and b. providing a second layer having the second affinity; and c. associating the first and second layers to facilitate imaging of the layers to form a lithographic image.

2. The method of claim 1 wherein the first and second layers are immediately adjacent.

3. The method of claim 1 wherein the first and second layers are associated by means of at least one intervening layer.

4. The method of claim 1 wherein the inorganic material is selected from the group consisting of metals, metal alloys, and metal-nonmetal compounds.

5. The method of claim 4 wherein the inorganic material is selected from the group consisting of copper, gold, silver, platinum, and palladium and the first affinity is oleophilicity.

6. The method of claim 5 wherein the inorganic material is copper.

7. The method of claim 5 wherein the first and second layers comprise polyester.

8. The method of claim 4 wherein the inorganic material is selected from the group consisting of aluminum, magnesium, and zinc, and the first affinity is hydrophilicity.

9. The method of claim 8 wherein the inorganic material is aluminum.

10. The method of claim 4 wherein the inorganic material comprises a compound consisting of at least one metal and at least one nonmetal, said at least one metal comprising at least one of titanium, zirconium, vanadium, niobium, tantalum, molybdenum, and tungsten, and said at least one nonmetal comprising at least one of boron, carbon, nitrogen, oxygen and silicon.

11. The method of claim 10 wherein the inorganic material is titanium nitride.

12. The method of claim 1 wherein the inorganic material is copper and the first affinity is oleophilicity.

13. The method of claim 12 wherein the first layer is polyester and the second layer is silicone.

14. The method of claim 1 wherein the at least one inorganic material is implanted by ion implantation.

15. The method of claim 14 wherein the at least one inorganic material comprises at least one metal and is implanted by plasma etching using a powered electrode comprising the at least one metal.

16. The method of claim 1 wherein the at least one inorganic material is implanted by sputtering.

17. The method of claim 1 wherein the first layer is polymeric.

18. The method of claim 1 wherein the at least one inorganic material is implanted to form a dispersion within the first layer.

19. A lithographic printing member comprising first and second layers having, respectively, first and second different affinities for at least one printing liquid selected from the group consisting of ink and an abhesive fluid for ink, the first layer being fabricated from a polymeric material having an inherent affinity, the first layer having implanted therein at least one inorganic material altering the inherent affinity to the first affinity.

20. The printing member of claim 19 further comprising an intermediate layer between the first and second layers.

21. The printing member of claim 20 wherein the intermediate layer comprises a material that ablatively absorbs imaging radiation.

22. The printing member of claim 19 wherein the inorganic material is selected from the group consisting of metals, metal alloys, and metal-nonmetal compounds.

23. The printing member of claim 22 wherein the inorganic material is selected from the group consisting of copper, gold, silver, platinum, and palladium and the first affinity is oleophilicity.

24. The printing member of claim 23 wherein the inorganic material is copper.

25. The printing member of claim 23 wherein the first and second layers comprise polyester.

26. The printing member of claim 22 wherein the inorganic material is selected from the group consisting of aluminum, magnesium, and zinc, and the first affinity is hydrophilicity.

27. The printing member of claim 26 wherein the inorganic material is aluminum.

28. The printing member of claim 22 wherein the inorganic material comprises a compound consisting of at least one metal and at least one nonmetal, said at least one metal comprising at least one of titanium, zirconium, vanadium, niobium, tantalum, molybdenum, and tungsten, and said at least one nonmetal comprising at least one of boron, carbon, nitrogen, oxygen and silicon.

29. The printing member of claim 28 wherein the inorganic material is titanium nitride.

30. The printing member of claim 19 wherein the inorganic material is copper and the first affinity is oleophilicity.

31. The printing member of claim 30 wherein the first layer is polyester and the second layer is silicone.

* * * * *